US005989405A

United States Patent [19]

Murata et al.

[11] Patent Number: 5,989,405

[45] Date of Patent: Nov. 23, 1999

[54] PROCESS FOR PRODUCING A DRESSER

[75] Inventors: Yasunori Murata; Kenji Kakui, both of Ichihara, Japan

[73] Assignee: Asahi Diamond Industrial Co., Ltd., Tokyo, Japan

[21] Appl. No.: 08/882,107

[22] Filed: Jun. 25, 1997

[30] Foreign Application Priority Data

Jun. 28, 1996 [JP] Japan ..... 8-188195

[51] Int. Cl.[6] ..... C25D 15/00

[52] U.S. Cl. ..... 205/110; 205/222; 205/223

[58] Field of Search ..... 205/109, 110, 205/114, 222, 223; 51/293, 309

[56] References Cited

U.S. PATENT DOCUMENTS

| | | | |
|---|---|---|---|
| 3,957,593 | 5/1976 | Haack | 205/110 |
| 4,381,227 | 4/1983 | Narcus | 428/626 |
| 5,389,228 | 2/1995 | Long et al. | 205/110 |

*Primary Examiner*—Kathryn Gorgos
*Assistant Examiner*—William T. Leader
*Attorney, Agent, or Firm*—Young & Thompson

[57] ABSTRACT

A dresser includes a super-abrasive fixed by electroplating on a working face which is disposed perpendicular to the axis of rotation of the dresser, the height of protrusion of particles of the super-abrasive is 5 to 30% of an average diameter of the particles, and a process for producing such a dresser includes temporarily fixing the super-abrasive in an amount to form a single layer to a base metal by electroplating, removing loose stones in the temporarily fixed super-abrasive by a grinder or shaking, electroplating a surface having the temporarily fixed super-abrasive with a metal until thickness of the plating metal reaches height of the most protruded part of the super-abrasive or until particles of the super-abrasive are completely buried in the plating metal, and working the electroplated surface for abrasive protrusion to expose most protruded parts of the super-abrasive resulting in a high accuracy dresser which enables dressing of a polishing pad in a short time and eliminates the releasing of particles of the super-abrasive with excellent flatness to the polishing pad.

8 Claims, 8 Drawing Sheets

PROCESS FOR PRODUCING A DRESSER

FIELD OF THE INVENTION

The present invention relates to a dresser and a process for producing the dresser. More particularly, the present invention relates to a dresser which enables dressing of a polishing pad for chemical and mechanical polishing of insulation films disposed between layers and metal wirings in semiconductor devices in a short time, prevents releasing of particles of a super-abrasive, and eliminates the possibility of damaging the surface of wafers; and a process for producing the dresser.

PRIOR ART OF THE INVENTION

For increasing the degree of integration and the speed of super LSI, multi-layer wiring is becoming more important, and further improvement is required for the process of flattening insulation films disposed between layers and metal wirings which plays the central role in the technology of the multi-layer wiring. Generally in an apparatus for polishing the surface of semiconductor wafers, a polishing pad is attached to a fixed plate of a disk shape, and one or a plurality of wafers are placed on the upper surface of the fixed plate which is attached with the polishing pad. A polishing fluid containing fine abrasive particles is supplied to the interface of the polishing pad and the wafers while the wafers are rotated on the polishing pad with force by a carrier, and the surfaces of the wafers are polished by the chemical and mechanical interactions at the interfaces.

As the polishing pad, a pad of the velour type prepared by impregnating a polyurethane resin in a polyester non-woven fabric, a pad of the suede type prepared by forming a layer of a cellular polyurethane on a substrate of a polyester non-woven fabric, or a pad of a cellular polyurethane having closed cells is used. As the abrasive particles, powder of ferrite, powder of alumina, barium carbonate, colloidal silica, or cerium oxide is used. As the polishing fluid, a solution of potassium hydroxide or dilute hydrochloric acid is used.

When the polishing of wafers is repeated, the speed of polishing is decreased because minute holes in the polishing pad are filled with cutting powder formed from the polished material and with abrasive particles to cause loading, and a mirror surface is formed on the polishing pad by the heat of chemical reaction between the abrasive particles and the wafer.

Therefore, dressing of the polishing pad must be conducted simultaneously or periodically. Super-abrasives are excellent materials for dressing, and dressing of a polishing pad used for polishing semiconductor wafers has been attempted by using super-abrasives. For example, in a process for increasing flatness of a polishing pad proposed in Japanese Patent Application Laid-Open No. Showa 64(1989)-71661, a correction ring is prepared by attaching a diamond pellet obtained by sintering a mixture of a diamond abrasive and powder of an alloy to an end face of a ring, or by placing a diamond abrasive on an end face of a ring in such a manner that the diamond abrasive is uniformly distributed on the face, followed by electroplating the obtained combination. The surface of a polishing pad is ground by relative movement of the polishing pad and the prepared correction ring to improve the flatness of the surface. However, this process has the following problems. When the correction ring is prepared by attaching a diamond pellet obtained by sintering a mixture of a diamond abrasive and powder of an alloy to an end face of a ring, there is the possibility that the alloy melts and remains on the pellet to contaminate the wafer during polishing of the wafer. Either when the correction ring is prepared by attaching a diamond pellet or when the correction ring is prepared by electroplating, it is preferred that a diamond abrasive having a small particle size in the range of #400 to #3000 is used. When a diamond abrasive coarser than #400 is used, the roughness of the surface of the polishing pad increases. Because a fine diamond abrasive must be used in this process, the polishing takes a long time.

In a process proposed in Japanese Patent Application Laid-Open No. Heisei 4(1992)-364730, a pellet prepared by fixing a diamond abrasive on a epoxy resin by electroplating is used for dressing of a polishing pad attached to a fixed plate of an apparatus for polishing a wafer. However, conventional dressers in which a diamond abrasive is fixed by electroplating have a problem that particles of the diamond abrasive are not existing in a single layer alone, and some particles which are disposed partially in the gap between the particles of the first layer are always existing as loose stones. The loose stones are detached from the layer and remain on the polishing pad to damage the surface of a wafer. Moreover, when the pellet is metal bonded, the metal is dissolved by the polishing fluid and remains on the semiconductor wafer to cause an adverse effect on the wafer. Particularly, copper which is used as the main component in metal bonding materials shows a large adverse effect.

In Japanese Patent Application Laid-Open No. Heisei 7(1995)256554, a truing apparatus for a polishing pad for wafers is proposed, wherein a truing grinder having an abrasive layer prepared by attaching a super-abrasive having a particle size of #60 to 230 by electroplating can be moved at an inclined position with respect to the axis of rotation. However, when the super-abrasive is fixed by a conventional electroplating, a problem arises in that particles of the super-abrasive are not existing in a single layer alone, but some particles which are disposed partially in the gap between the particles of the first layer are always existing as loose stones, and the loose stones are detached from the layer and remain on the polishing pad to damage the surface of wafers.

In a dresser in which a super-abrasive is fixed by a conventional electroplating, particles of the super-abrasive are buried directly after the particles of the super-abrasive are temporarily fixed. This means that a dresser is used in the condition that the height of protrusion of particles is 40% of the average diameter of the particles while many particles of the super-abrasive are still remaining as loose stones. The above situation always causes the problem that particles of the super-abrasive existing as loose stones are detached to remain on the polishing pad, and the surface of wafers is damaged to cause decrease in the flatness.

SUMMARY OF THE INVENTION

Accordingly, the present invention has an object of providing a high accuracy dresser which enables dressing of a polishing pad in a short time, eliminates the possibility of releasing of particles of a super-abrasive, and provides excellent flatness to the polishing pad; and a process for producing the dresser.

As the result of extensive studies by the present inventors to solve the above problems, it was discovered that the height of protrusion of particles of a super-abrasive can be controlled by temporarily fixing the super-abrasive in an amount to form a single layer to a base metal by electroplating, removing loose stones from the temporarily fixed super-abrasive, completely burying the super-abrasive by electroplating, and working the plated surface for the abrasive protrusion. The present invention has been completed on the basis of the discovery.

Thus, the present invention provides:

(1) A dresser which comprises a super-abrasive fixed by electroplating on a working face which is disposed perpendicular to the axis of rotation of the dresser, wherein height of protrusion of particles of the super-abrasive is 5 to 30% of an average diameter of the particles;

(2) A dresser described in (1), wherein the dresser is used for dressing a polishing pad for chemical and mechanical polishing;

(3) A process for producing a dresser described in (1) which comprises temporarily fixing the super-abrasive in an amount to form a single layer to a base metal by electroplating, removing loose stones in the temporarily fixed super-abrasive by a grinder, and burying the super-abrasive in a layer of a metal by electroplating so that height of protrusion of particles of the super-abrasive is 5 to 30% of an average diameter of the particles;

(4) A process for producing a dresser described in (4) which comprises temporarily fixing the super-abrasive in an amount to form a single layer to a base metal by electroplating, removing loose stones in the temporarily fixed super-abrasive by a grinder, electroplating a surface having the temporarily fixed super-abrasive with a metal until thickness of the plating metal reaches height of the most protruded part of the super-abrasive or until particles of the super-abrasive are completely buried in the plating metal, and working the electroplated surface for abrasive protrusion to expose most protruded parts of the super-abrasive;

(5) A process described in (4), wherein the electroplated surface is worked for the abrasive protrusion by chemical etching or by electrolytic etching; and (6) A process according to (5), wherein the electroplated surface is worked by grinding before being worked by the chemical etching or by the electrolytic etching.

Figure 1:
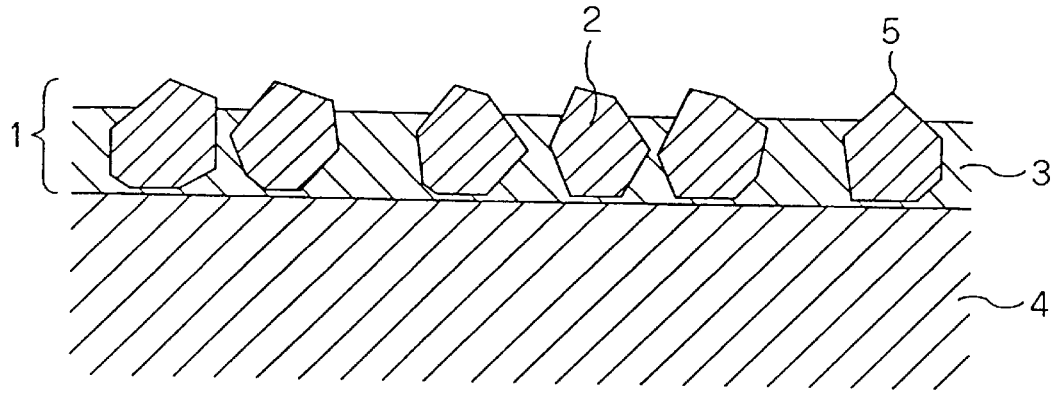
FIG. 1 shows a partial sectional view of a layer of a super-abrasive in a dresser of the present invention.

The numbers in the figures have the meanings as listed in the following:

1: a layer of a super-abrasive
2: a particle of a super-abrasive
3: a fixing layer
4: a base metal
5: the most protruded part of a particle of a super-abrasive
6: a loose stone
7: a surface for fixing a super-abrasive
8: a mask
9: a grinding machine
10: an electroplating layer
11: a groove
12: a chip of a super-abrasive

DETAILED DESCRIPTION OF THE INVENTION

The present invention is described in detail in the following with reference to figures.

FIG. 1 shows a partial sectional view of a layer of a super abrasive in a dresser of the present invention. The layer of a super-abrasive 1 comprises particles of the super-abrasive 2 and a fixing layer 3 in which the particles of the super-abrasive are buried so that the particles of the super-abrasive are fixed to a base metal 4. In the dresser of the present invention, the height of protrusion of the particles of the super-abrasive is 5 to 30%, preferably 10 to 20%, of the average diameter of the particles.

Figure 2:
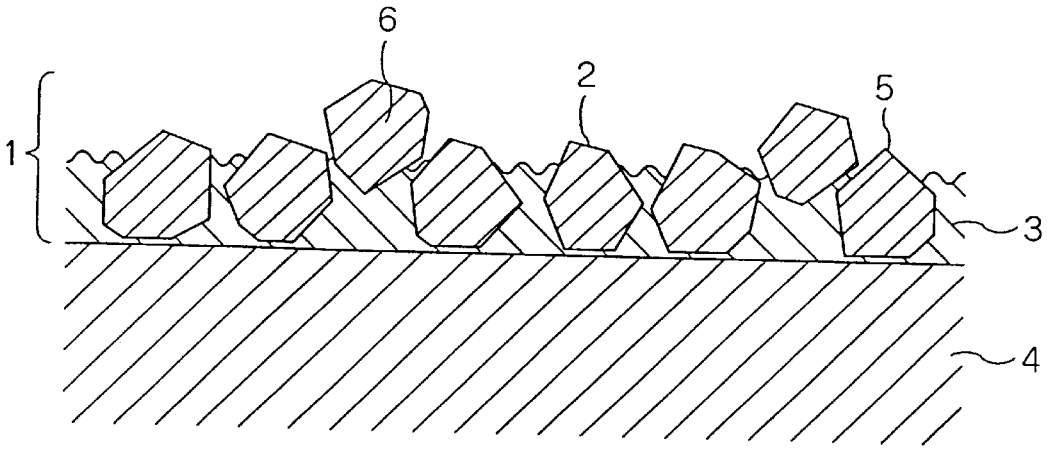
FIG. 2 shows a partial sectional view of a layer of a super-abrasive in a conventional dresser.

FIG. 2 shows a partial sectional view of the layer of a super abrasive in a conventional dresser. In the conventional dresser, a super-abrasive 2 in an amount to form a single layer is temporarily fixed to a base metal 4 by electroplating, and then the electroplating is continued so that a fixing layer 3 is formed to fix the super-abrasive to the base metal. Therefore, it is difficult to completely prevent the formation of so-called loose stones 6 which are particles of the super-abrasive not completely fixed to the layer of the super-abrasive 1. Moreover, the roughness of the surface of the plating layer increases with increase in the thickness to cause an inferior flatness.

In the dresser of the present invention, the height of protrusion of particles of the super-abrasive is 5 to 30% of the average diameter of the particles, and the dresser exhibits an excellent dressing effect when the dresser is used for dressing a polishing pad. When the height of protrusion of particles of the super-abrasive is less than 5% of the average diameter of the particles, there is the possibility that the dressing effect is decreased. When the height of protrusion of particles of the super-abrasive is more than 30% of the average diameter of the particles, the force to retain the particles of the super-abrasive is weak, and there is the possibility that particles of the super-abrasive are detached during working and left remaining in the polishing pad to cause damage on materials for polishing. Moreover, the dressing effect is excessively large, and there is the possibility that the polishing pad is damaged.

In the dresser of the present invention, a diamond abrasive or a CBN (cubic boron nitride) abrasive can be used as the super-abrasive. The particle size of the super-abrasive is preferably #35 to #200, more preferably #80 to #120. When the particle size of the super-abrasive is larger than #35, problems arise as follows. When a diamond abrasive is used, a natural diamond must be used, and the super-abrasive becomes very expensive. When a CBN abrasive is used, a hard abrasive having a particle size larger than #35 is not easily available. Moreover, when the particle size of the super-abrasive is larger than #35, there is the possibility that the dressing effect on a polishing pad is decreased although the dresser of the present invention is used. When the particle size of the super-abrasive is smaller than #200, it is difficult that a sufficient height of protrusion of particles of the abrasive is surely obtained. Moreover, the flatness of the dressed polishing pad is not increased to the degree expected from the particle size, and the time of dressing is increased without the expected effect.

In the dresser of the present invention, the flatness of the surface which is formed by the most protruded parts of individual particles of a super-abrasive is determined by the distribution of the particle size of the super-abrasive. Therefore, it is preferred that a super-abrasive having a narrow distribution of the particle size is used. A super-abrasive having a narrow distribution of the particle size is preferably used also because of easier control of the height of protrusion. Some types of artificial diamond have blocky shapes, and such diamonds are particularly preferably used as the super-abrasive. In order to obtain a uniform distribution of the particle size of a super-abrasive, it is preferred that a super-abrasive is treated in accordance with the method of Japanese Industrial Standard B 4130, and the fraction which passes through the second sieve and remains at the third sieve is used.

In a conventional dresser for dressing of a polishing pad, the presence of loose stones is inevitable. Therefore, there is the possibility that particles of a super-abrasive present as loose stones are detached during the dressing, remain on the polishing pad, and damage the surface of wafers during polishing of the wafers. In the dresser of the present invention, particles of the super-abrasive are all buried in a fixing layer and firmly fixed. Therefore, there is no possibility that particles of the super-abrasive are detached during the dressing and damage the surface of wafers during polishing of the wafers.

The process for producing the dresser of the present invention is described in the following.

Figure 3:
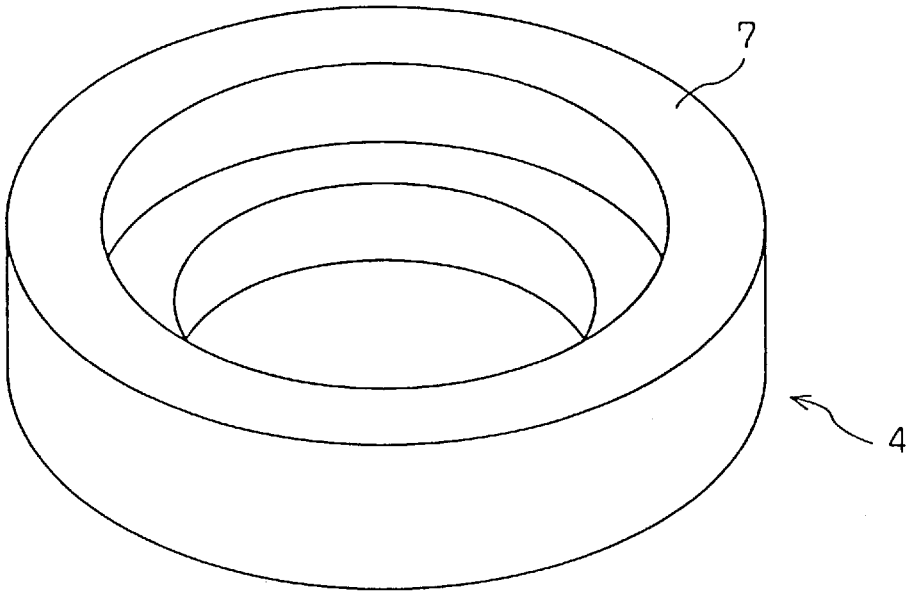
FIG. 3 shows a perspective view of a base metal.
Figure 4A:
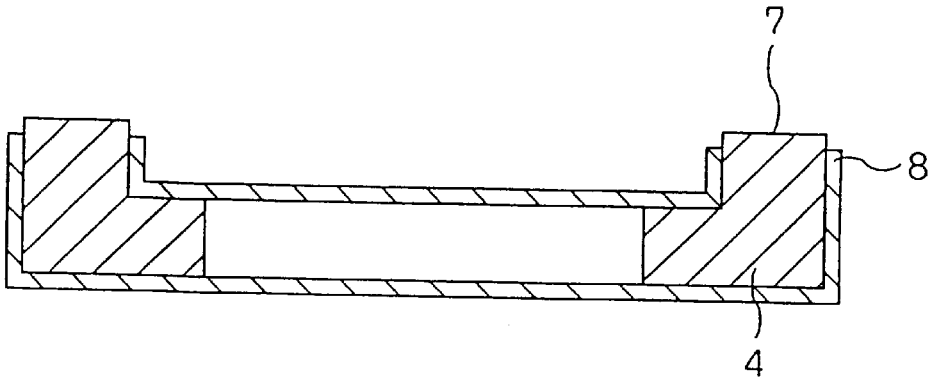
FIG. 4(*a*), FIG. 4(*b*), and FIG. 4(*c*) show sectional views describing an embodiment of forming a layer of a super-abrasive.
Figure 4B:
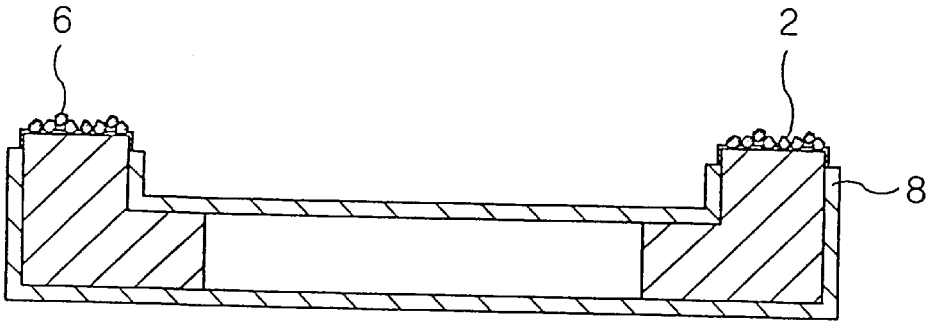
Figure 4C:
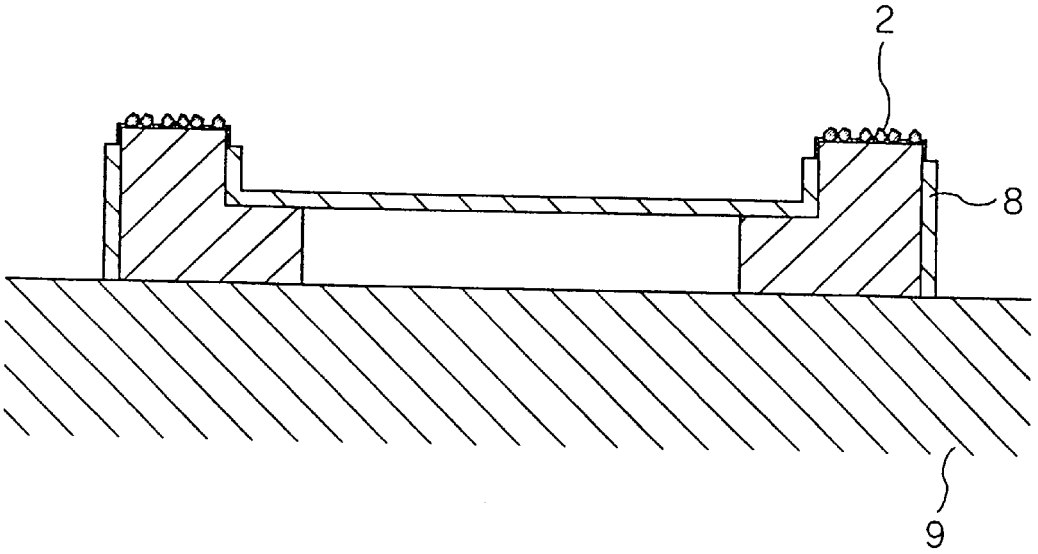

FIG. 3 shows a perspective view of a base metal. FIG. 4 shows sectional views describing an embodiment of forming a layer of a super-abrasive. In the process of the present invention, a base metal 4 is prepared, and then the base metal is covered with a mask 8 made of an electric insulating material except the surface for fixing a super-abrasive as shown in FIG. 4(*a*). The covered base metal is dipped into a plating bath, and a super-abrasive 2 is placed on the surface for fixing a super-abrasive. Then, electroplating is conducted by connecting the base metal to a cathode and the plating solution to an anode. The metal used for the electroplating is not particularly limited as long as the super-abrasive can be temporarily fixed. For example, nickel or chromium can advantageously be used. When the super-abrasive in an amount to form a single layer is temporarily fixed so that the super-abrasive is not detached from the surface for fixing a super-abrasive, the excess amount of the super-abrasive is removed from the surface for fixing a super-abrasive. FIG. 4(*b*) shows the condition in which the super-abrasive in an amount to form a single layer is temporarily fixed to the surface for fixing a super-abrasive. When the super-abrasive is temporarily fixed by the electroplating, most of the particles of the super-abrasive are temporarily fixed in such a manner that a part of each particle is attached to the surface for fixing a super-abrasive of the base metal. However, some of the particles of the super-abrasive are present in such a condition that no part of each particle is attached to the surface for fixing a super-abrasive of the base metal, i.e. as loose stones 6. When the base metal is placed on a grinding machine 9 and the surface of the layer of the super-abrasive is lightly polished by using an alumina grinder or a silicon carbide grinder, the loose stones are removed to achieve the condition shown in FIG. 4(*c*). The loose stones may be remove by alternative methods including shaking to remove the loosest stones.

Figure 5A:
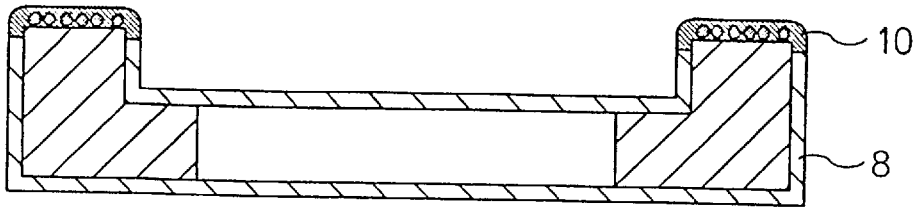
FIG. 5(*a*), FIG. 5(*b*), and FIG. 5(*c*) show sectional views describing an embodiment of forming a layer of a super-abrasive.
Figure 5B:
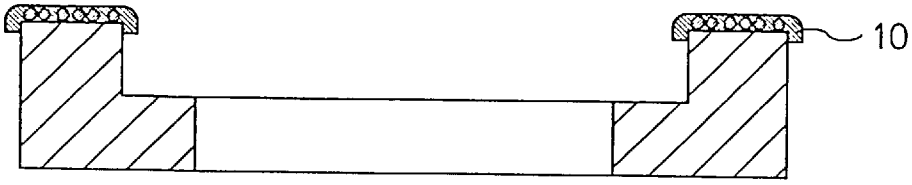
Figure 5C:
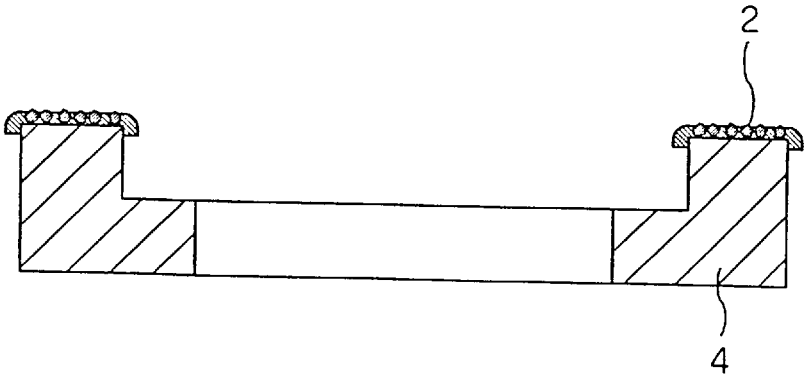
Figure 6A:
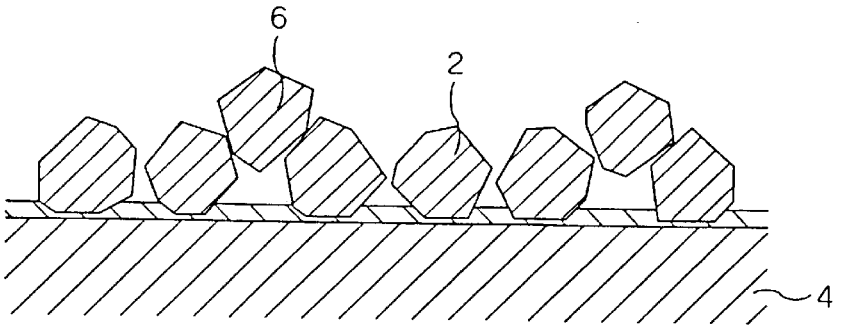
FIG. 6(*a*), FIG. 6(*b*), FIG. 6(*c*), FIG. 6(*d*), and FIG. 6(*e*) show partial sectional views of a layer of a super-abrasive in steps for forming the layer of a super-abrasive.
Figure 6B:
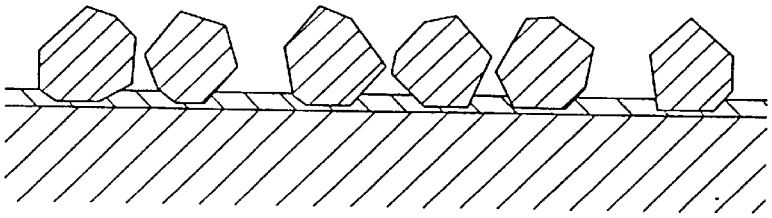
Figure 6C:
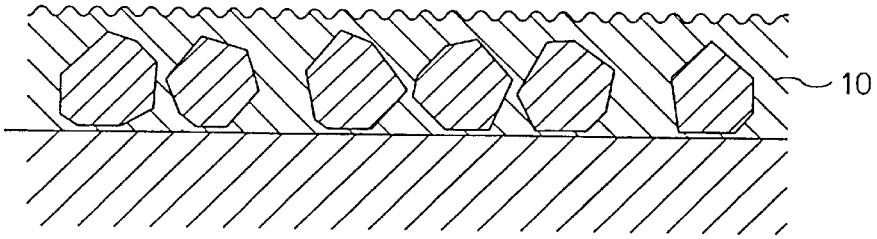
Figure 6D:
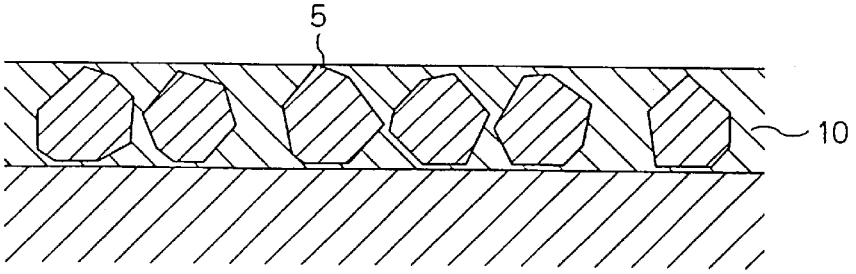
Figure 6E:
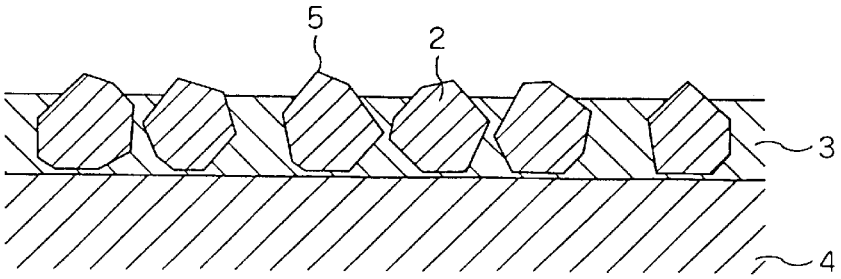

FIG. 5 shows sectional views describing an embodiment of forming a layer of the super-abrasive after the steps shown in FIG. 4. The base metal obtained above is dipped into a plating bath. The surface for fixing a super-abrasive is plated with a metal by connecting the base metal to a cathode and the plating solution to an anode. The electroplating is conducted until the thickness of the plating metal reaches the height of the most protruded part of the particles of the temporarily fixed super-abrasive or until particles of the super-abrasive are completely buried in the plating metal, and the condition shown in FIG. 5(*a*) is achieved. The metal used for the electroplating is not particularly limited as long as the super-abrasive can be fixed. For example, nickel or chromium can be used, and it is particularly preferred that nickel is used. When a bath of nickel sulfamate containing additives is used for fixing the super-abrasive by the electroplating with nickel, the obtained nickel layer has a hardness of HV 400 to 600 and an elongation rate of 1 to 5%, and the obtained fixing layer of nickel has a sufficient toughness. Therefore, the dressing of a polishing pad can efficiently be conducted with good accuracy, and releasing of particles of the super-abrasive does not take place for a long time.

When the electroplating is conducted until particles of the super-abrasive are completely buried in the plating metal, the obtained plating layer is worked by grinding until the most protruded part of the super-abrasive can be seen. After the mask covering the base metal is completely removed, the base metal is placed on a grinding machine, and the plating layer is ground until the most protruded part 5 can be seen, to achieve the condition shown in FIG. 5(*b*). Then, the surface of the layer of the super-abrasive is worked for the abrasive protrusion, and the most protruded parts of the individual particles of the super-abrasive are exposed to obtain the dresser of the present invention shown in FIG. 5(*c*). The working for the abrasive protrusion can be conducted, for example, by dressing using a conventional grinder, by dressing with free particles of an abrasive, such as silicon carbide and alumina, on a fixed plate, such as a fixed plate of cast iron, by shot blasting, by chemical etching with an agent for removing a metal, or by electrolytic etching. The chemical etching is conducted by dipping the product obtained in the above into a chemical material which dissolves the fixing layer alone among the materials forming the base metal and the layer of the super-abrasive. As the chemical material, a commercial agent, such as ENSTRIP NP (a product of MELTEX Inc.) for a fixing layer made of nickel and ENSTRIP CR-5 (a product of MELTEX Inc.) for a fixing layer made of chromium, may be used. In the present invention, even when roughness is formed on the fixing layer after the electroplating, the flatness of the fixing layer is improved by the above working for the abrasive protrusion, and a polishing pad is not damaged.

In the process of the present invention, lapping can additionally be conducted where necessary. In the lapping, protruded tips of particles of the super-abrasive are cut by using a diamond abrasive. By the working for the abrasive protrusion and the lapping, a dresser can exhibit the stable and excellent performance from the beginning of the use.

Figure 7:
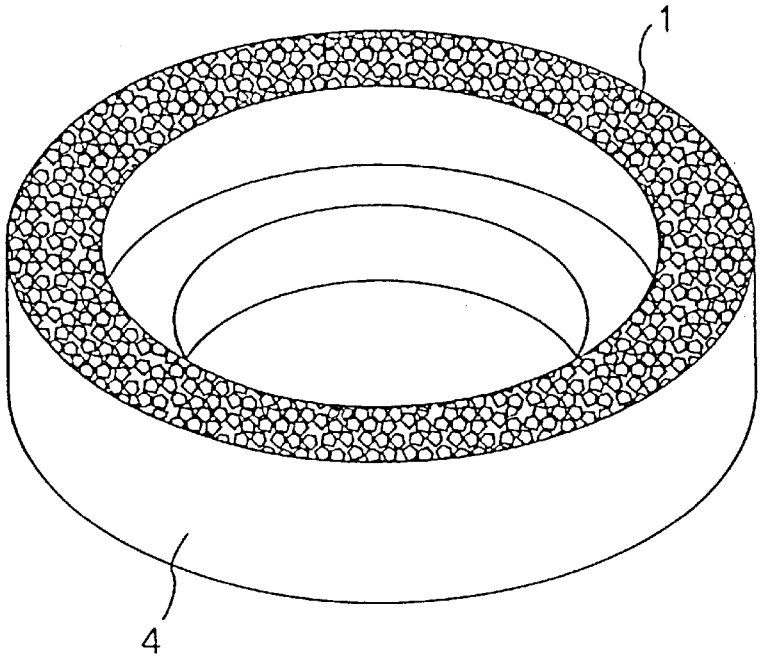
FIG. 7 shows a perspective view of an embodiment of the dresser of the present invention.

FIG. 6 shows partial sectional views of a layer of a super-abrasive in the steps for forming the layer of a super-abrasive in the embodiment shown in FIGS. 4 and 5. FIG. 6(*a*) shows the condition in which a super-abrasive 2 in an amount to form a single layer is temporarily attached to a base metal 4, and loose stones 6 are present. FIG. 6(*b*) shows the condition in which the loose stones have been removed by grinding. FIG. 6(*c*) shows the condition in which the electroplating has subsequently been conducted, and the super-abrasive is completely buried in the plating layer of a metal 10. FIG. 6(*d*) shows the condition in which the plating layer is worked by grinding, and the layer of the plating metal has been removed until the most protruded part 5 of the super-abrasive can be seen. FIG. 6(*e*) shows the condition in which the plating layer is worked for the abrasive protrusion to expose the most protruded parts of individual particles of the super-abrasive, and the layer of the super-abrasive 1 is formed to complete the dresser of the present invention. The particles 2 of the super-abrasive are fixed by the fixing layer 3, and a part of each particle of the super-abrasive is attached to the surface of the base metal 4. The height of protrusion of the most protruded part 5 of each particle is 5 to 30% of the average diameter of the particles. FIG. 7 shows a perspective view of this dresser. This dresser has a layer of the super-abrasive 1 of a ring shape on a base metal 4 of a cup shape.

Figure 8:
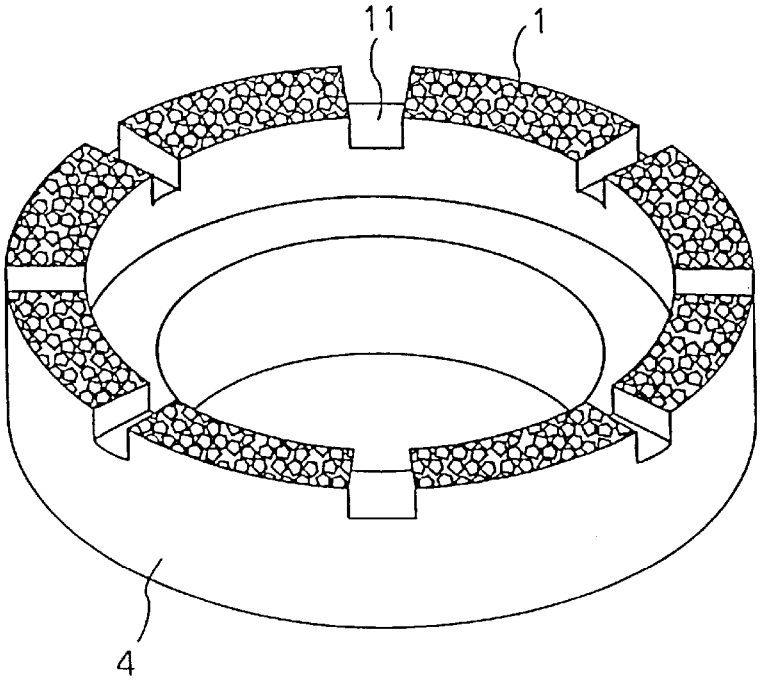
FIG. 8 shows a perspective view of another embodiment of the dresser of the present invention.
Figure 9A:
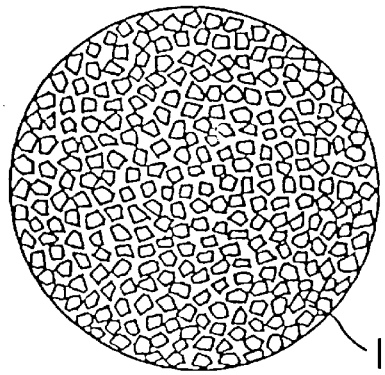
FIG. 9(*a*), FIG. 9(*b*), FIG. 9(*c*), FIG. 9(*d*), FIG. 9(*e*), and FIG. 9(*f*) show plan views of the surfaces of layers of a super-abrasive in the dresser of the present invention.
Figure 9B:
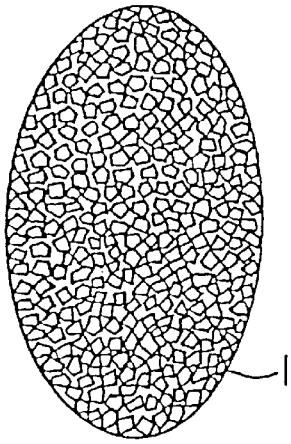
Figure 9C:
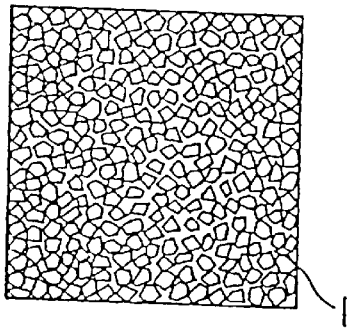
Figure 9D:
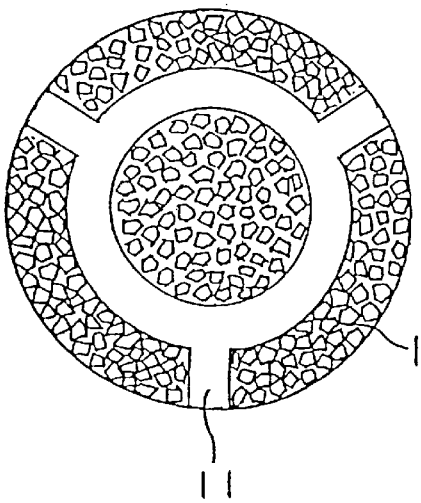
Figure 9E:
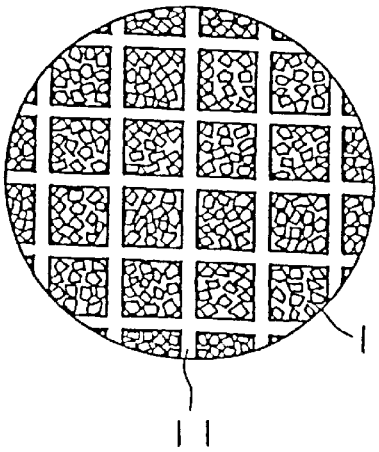
Figure 9F:
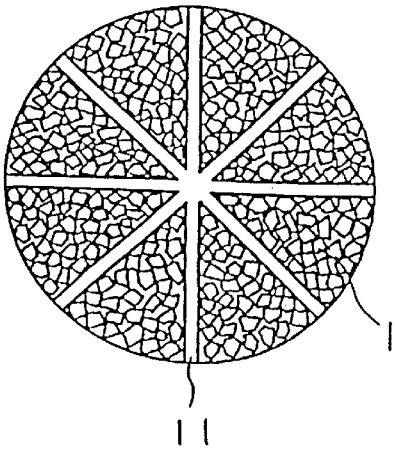

In the dresser of the present invention, grooves may be formed on the surface having the super-abrasive in radial directions from the central axis, and thus the layer of the super-abrasive may be divided into separate parts by the radial grooves. FIG. 8 shows a perspective view of another embodiment of the dresser of the present invention. The dresser shown in FIG. 8 has eight layers of the super-abrasive 1 which are separated from each other by eight grooves 11 on a base metal 4. By forming grooves to separate the layers of the super-abrasive as shown in the above, inward and outward flow of a polishing agent and discharge of cutting powder can be facilitated during dressing of a polishing pad, and thus the speed and the accuracy of dressing can be increased further.

In the dresser of the present invention, the surface of the layer of a super-abrasive may have any desired shape. FIG. 9 shows plan views of the surfaces of the layer of a super-abrasive in the dresser of the present invention. FIG. 9(*a*) shows a plan view of the surface of a layer of a super-abrasive having a circular shape. FIG. 9(*b*) shows a plan view of the surface of a layer of a super-abrasive having an elliptic shape. FIG. 9(*c*) shows a plan view of a layer of a super-abrasive having a rectangular shape. In a layer of a super-abrasive, a groove 11 may be formed to separate the layer of a super-abrasive into parts. FIG. 9(*d*) shows a combination of a groove of a ring shape and radial grooves. FIG. 9(*e*) shows grooves of a grid shape, and FIG. 9(*f*) shows radial grooves. By forming grooves as shown in the above, inward and outward flow of a polishing agent and discharge of cutting powder can be facilitated during dressing of a polishing pad, and thus the speed and the accuracy of dressing can be increased further.

Figure 10:
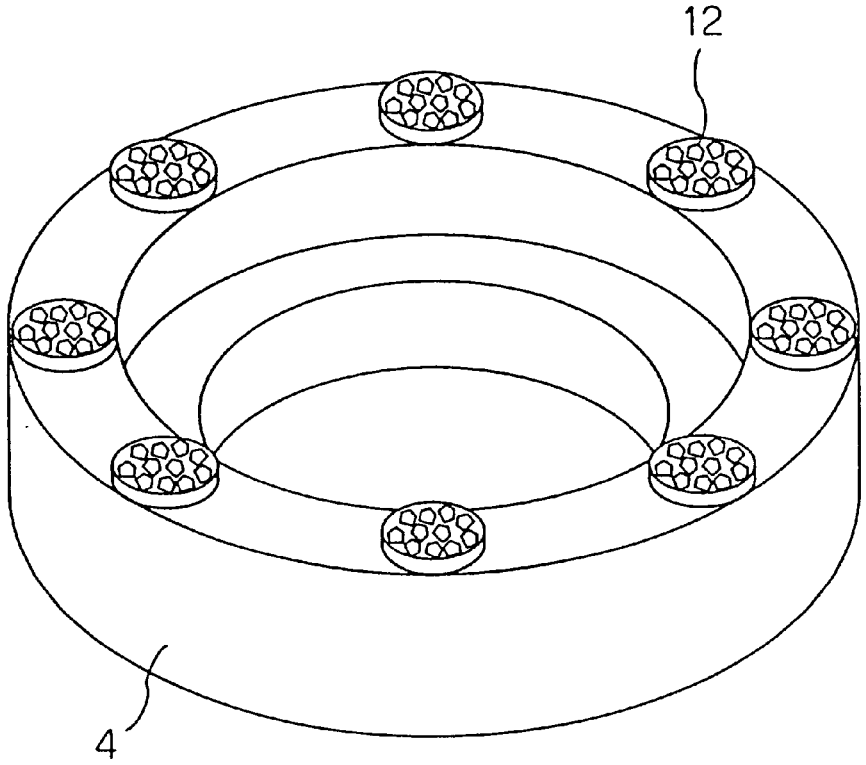
FIG. 10 shows a perspective view of another embodiment of the dresser of the present invention.

The dresser of the present invention can be prepared by fixing a super-abrasive directly to a base metal by electroplating as described above or, alternatively, by bonding chips of a super-abrasive to a base metal. A super-abrasive in an amount to form a single layer is temporarily fixed to a chip mold by electroplating, and loose stones in the temporarily fixed super-abrasive are removed. Then, the surface of the chip mold having the temporarily fixed super-abrasive is electroplated with a metal until thickness of the plating metal reaches the height of the most protruded part of the super-abrasive or until particles of the super-abrasive are completely buried in the plating metal. The electroplated surface of the chip mold having the super-abrasive is worked for the abrasive protrusion to expose the most protruded parts of the individual particles of the super-abrasive. The chip mold is then removed from the resultant product to obtain a chip of the super-abrasive. FIG. 10 shows a perspective view of another embodiment of the dresser of the present invention. The dresser shown in FIG. 10 has eight chips of a super-abrasive having a circular shape 12 which are bonded to a base metal 4 having a shape of a cup. The chip of the super-abrasive can be bonded to the base metal by using an adhesive or a screw. The adhesive used for the bonding is not particularly limited as long as the adhesive has a sufficient strength. For example, an epoxy adhesive can advantageously be used.

When the dresser of the present invention is used, releasing of particles of a super-abrasive during dressing of a polishing pad can be prevented, and formation of damages during the polishing of insulation films disposed between layers or metal wirings of semiconductor devices can be prevented. The flatness of the polishing pad is increased, and the sharpness of the polishing pad is also increased.

To summarize the advantages of the present invention, because the height of protrusion of particles of a super-abrasive is 5 to 30% of the average diameter of the particles and loose stones are absent in the dresser of the present invention, dressing of a polishing pad can be achieved with excellent flatness even when the dressing is conducted by using a super-abrasive of a large particle diameter at an increased speed. Because particles of the super-abrasive are firmly buried in a fixing layer and tightly fixed, there is no possibility that the particles of the super-abrasive are detached to damage the surface of wafers. Moreover, in accordance with the process of the present invention, the dresser having the above excellent characteristics can be produced by a simplified process.

EXAMPLES

The present invention is described in more detail with reference to examples in the following. However, the present invention is not limited by the examples.

Examples 1

A base metal having a shape shown in FIG. 8 and a dimension of 240D-10W-20T-132H was prepared from stainless steel (SUS304) by working using a lathe. Then, the surface of the base metal except the surface for fixing a diamond abrasive was masked with an insulation tape and a coating material. The base metal was then treated for degreasing with an alkali and dipped into a pretreatment fluid containing 240 g/liter of nickel chloride and 100 g/liter of hydrochloric acid. The dipped base metal was set to an anode and electrolytically etched under a current density of 10 A/dm$^2$ at an ordinary temperature for 2 minutes. Then, the base metal was set to a cathode, and the strike plating was conducted for 3 minutes. The treated base metal was plated in a plating bath of nickel sulfamate under a current density of 1 A/dm$^2$ for 15 minutes to form a plating underlayer of 3 $\mu$m.

Then, a diamond abrasive having a particle size of #100/120 and an average diameter of 149 $\mu$m (MBG-660T, a product of GENERAL ELECTRIC Company) was placed on the surface for fixing a diamond abrasive of the base metal, and the obtained combination was electroplated by using a plating bath of nickel sulfamate containing additives for adjusting the plating stress and the hardness under a current density of 0.5 A/dm$^2$ for 3 hours to temporarily fix the diamond abrasive in an amount to form a single layer.

After the diamond abrasive present in the excess amount was removed by shaking, electroplating was conducted for burying the abrasive under a current density of 1 A/dm$^2$ for 15 hours. Then, loose stones of the diamond abrasive were removed by a #100 alumina grinder. See FIG. 4(*c*).

The obtained product was dipped in a pretreatment fluid containing 240 g/liter of nickel chloride and 100 g/liter of hydrochloric acid. The dipped product was set to an anode and eletrolytically etched under a current density of 10 A/dm$^2$ at an ordinary temperature for 30 seconds. Then, the product was set to a cathode, and the strike plating was conducted for 2 minutes. The resultant product was plated in a plating bath of nickel sulfamate under a current density of 1 A/dm$^2$ for 15 minutes and subsequently plated in the same plating bath of nickel sulfamate under a current density of 1 A/dm$^2$ for 7.5 hours to form a plating layer having a thickness of about 250 $\mu$m so that the diamond abrasive was completely buried in the plating layer. See FIG. 5(*b*).

The mask was completely removed, and the plated surface for fixing the diamond abrasive was worked by grinding using a face grinding machine with a #100 alumina grinder until the diamond abrasive was slightly exposed. See FIG. 5(*c*) The resultant product was worked for the abrasive protrusion by the chemical etching using a nickel remover ENSTRIP NP (a product of MELTEX Co., Ltd.) at 90° C. for 1 hour to dissolve about 20 $\mu$m of nickel on the layer of the diamond abrasive, and then worked for the lapping by a diamond grinder to obtain a dresser of the present invention.

The obtained dresser had a layer of the fixed diamond abrasive having the thickness of 160 $\mu$m, the average height of protrusion of particles of the diamond abrasive of 20 $\mu$m, and the height of protrusion of particles of the diamond abrasive of 13.4% of the average diameter of the particles. When the surface of the layer of the diamond abrasive of this dresser was observed by a scanning electron microscope, no loose stones of the diamond abrasive were found.

By using the thus prepared dresser, dressing of a polishing pad of the suede type which was made by forming a layer of foamed polyurethane on a substrate of a polyester non-woven fabric was conducted. The dressing could be achieved efficiently with an excellent flatness.

Comparative Example 1

The same procedures as those conducted in Example 1 were conducted except that, after the diamond abrasive in amount to form a single layer was temporarily fixed and the diamond abrasive in the excess amount was removed, the procedure of removing loose stones of the diamond abrasive was not conducted, and the obtained product was directly electroplated under a current density of 1 A/dm$^2$ for 3 hours to form a plating layer having a thickness of about 80 $\mu$m.

The obtained dresser had a layer of the fixed diamond abrasive having the average height of protrusion of particles of the diamond abrasive of 69 $\mu$m and the height of protrusion of particles of the diamond abrasive of 46% of the average diameter of the particles. When the surface of the layer of the diamond abrasive was observed by a scanning electron microscope, one loose stone was found per 15 particles of the diamond abrasive.

By using the thus prepared dresser, dressing of a polishing pad of the suede type which was made by forming a layer of foamed polyurethane on a substrate of a polyester non-woven fabric was conducted. Large damage was formed on the non-woven fabric, and the dressed polishing pad could not be used as a polishing pad.

What is claimed is:

1. A process for manufacturing a dresser comprising abrasive particles fixed by electroplating on a working face disposed perpendicular to an axis of rotation of the dresser, said method comprising the steps of:

temporarily fixing the abrasive particles in an amount to form a single layer to a base metal by a first electroplating;

removing loose abrasive particles in the temporarily fixed abrasive particles by grinding;

burying the temporarily fixed abrasive particles by covering the temporarily fixed abrasive particles in a metal layer by a second electroplating; and removing an upper portion of the metal layer, wherein said removing step produces a finished dresser having 5 to 30% of an average diameter of the abrasive particles exposed.

2. The method of claim 1, wherein said step of temporarily fixing the abrasive particles in an amount to form a single layer to a base metal by a first electroplating, utilizes one of diamond abrasive and cubic boron nitride abrasive.

3. The method of claim 2, wherein said step of removing an upper portion of the metal layer is limited to expose only 10 to 20% of an average diameter of the abrasive particles.

4. The method of claim 3, wherein said step of removing an upper portion of the metal layer is limited to expose only 10 to 20% of an average diameter of the abrasive particles is performed by one of chemical etching and electrolytic etching.

5. The method of claim 4, wherein said step of removing an upper portion of the metal layer is performed by grinding prior to said step exposing only 10 to 20% of an average diameter of the abrasive particles by one of chemical etching and electrolytic etching.

6. A process of manufacturing a dresser with abrasive particles electroplatedly fixed on a working face disposed perpendicular to an axis of rotation of the dresser, said method comprising the steps of:

temporarily fixing one of diamond abrasives and cubic boron nitride abrasives to form a single layer of temporarily fixed abrasive particles to a base metal by a first electroplating;

removing loose abrasive particles in the temporarily fixed abrasive particles by grinding;

burying the temporarily fixed abrasive particles in a metal layer by a second electroplating so that the temporarily fixed abrasive particles become permanently fixed abrasive particles, the thickness of the metal layer being such that the metal layer substantially reaches a height of a most protruded part of the temporarily fixed abrasive particles;

removing by grinding an upper surface portion of the metal layer to expose protruding parts of the permanently fixed abrasive particles; and removing by one of chemical etching and electrolytic etching a further upper surface portion of the metal layer to expose additional protruding parts of the permanently fixed abrasive particles, wherein said removing steps produce a finished dresser having 10 to 20% of an average diameter of the abrasive particles exposed.

7. A process of manufacturing a dresser comprising exposed abrasive particles fixed on a working face disposed perpendicular to an axis of rotation of the dresser, said method comprising the steps of:

fixing one of diamond abrasives and cubic boron nitride abrasives in a single layer of abrasive particles to a base metal by a first electroplating;

removing loose stones in the single layer of abrasive particles;

permanently fixing the single layer of abrasive particles in a metal layer formed by a second electroplating, the thickness of the metal layer being such that the metal layer substantially reaches a height of a most protruded part of the abrasive particles;

controllably removing an upper surface portion of the metal layer to expose 10 to 20% of an average diameter of the abrasive particles above an upper final surface of the dresser.

8. The method of claim 7, wherein said removing step comprises the further steps of:

grinding an initial upper surface portion followed by one of chemical etching and electrolytic etching a further upper surface portion of the metal layer.

* * * * *